US006719603B2

(12) United States Patent
Chan

(10) Patent No.: US 6,719,603 B2
(45) Date of Patent: Apr. 13, 2004

(54) INTERACTIVE TOY PLAY SET WITH SENSORS

(75) Inventor: Albert Wai Tai Chan, Taipei (TW)

(73) Assignee: Thinking Technology, Inc., Nassau (BS)

( * ) Notice: Subject to any disclaimer, the term of this patent is extended or adjusted under 35 U.S.C. 154(b) by 26 days.

(21) Appl. No.: 10/230,246

(22) Filed: Aug. 29, 2002

(65) Prior Publication Data

US 2003/0153238 A1 Aug. 14, 2003

Related U.S. Application Data

(60) Provisional application No. 60/316,016, filed on Aug. 31, 2001.

(51) Int. Cl.[7] ..... A63H 30/00
(52) U.S. Cl. ..... 446/175; 446/481
(58) Field of Search ..... 446/175, 297, 446/397, 85, 91, 484, 481

(56) References Cited

U.S. PATENT DOCUMENTS 4,333,258 A * 6/1982 McCaslin ..... 446/130
4,820,233 A * 4/1989 Weiner ..... 446/303
5,451,178 A * 9/1995 Yorozu et al. ..... 446/175
6,641,455 B2 * 11/2003 Chan ..... 446/297

* cited by examiner

*Primary Examiner*—Jacob K. Ackun
*Assistant Examiner*—Jamila Williams
(74) *Attorney, Agent, or Firm*—Kramer & Amado, P.C.; Gordon J. Zimmerman, Esq.

(57) ABSTRACT

A toy play set comprises: a body portion comprising: sound reproduction means; processing means comprising an integrated circuit comprising pre-programmed data adapted to be converted to audible sounds by said sound reproduction means; a source of electrical power to power said integrated circuit and said sound reproduction means; a base comprising first location means and sensor means; said sensor means adapted for electromagnetic communication with said integrated circuit; a play item comprising: second location means; status means adapted to be sensed by the sensor means; said first location means adapted to cooperate with said second location means to locate the play item adjacent the base; such that when the play item is located adjacent the base and its status means is sensed by the sensor means, said sensor means generates a signal which is particular to said play item, said signal is transmitted to said integrated circuit, said integrated circuit generates a data segment from said pre-programmed data, which data segment is appropriate to said play item, and said data segment is audibly reproduced by said sound reproduction means.

31 Claims, 10 Drawing Sheets

45
57
63
51
99
97
95
33
31
37
35
40
39
100
96
98
94
93

53

65
59
47
45
49
51
55
57
67
61
63
31
37
35
43
33
69
39
40
41

FIG. 7A.
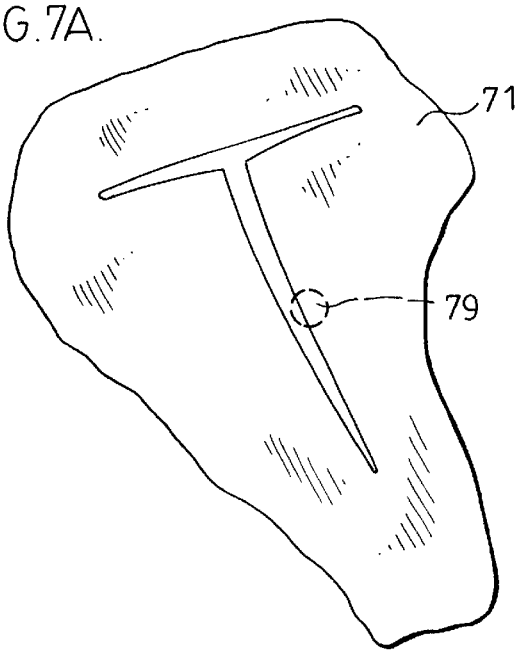
FIG. 7B.
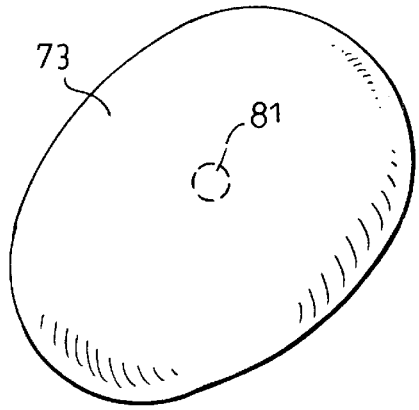
FIG. 7C.
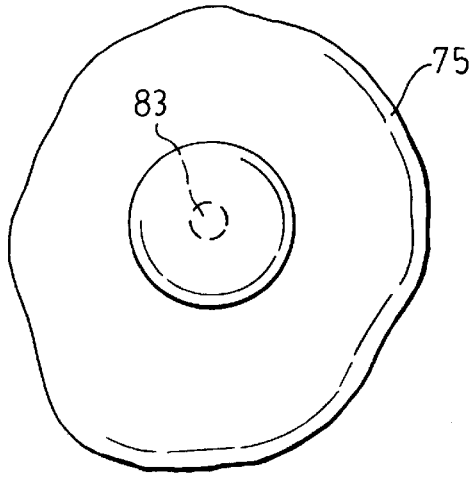
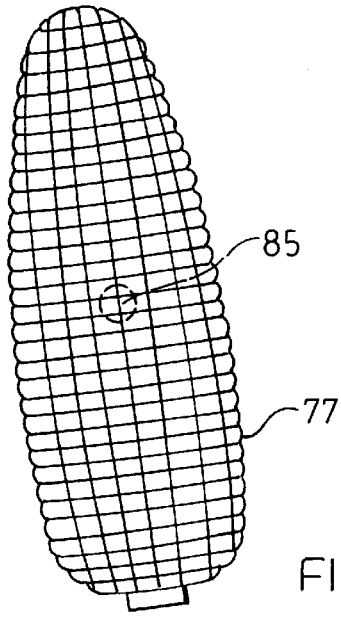
FIG. 7D.

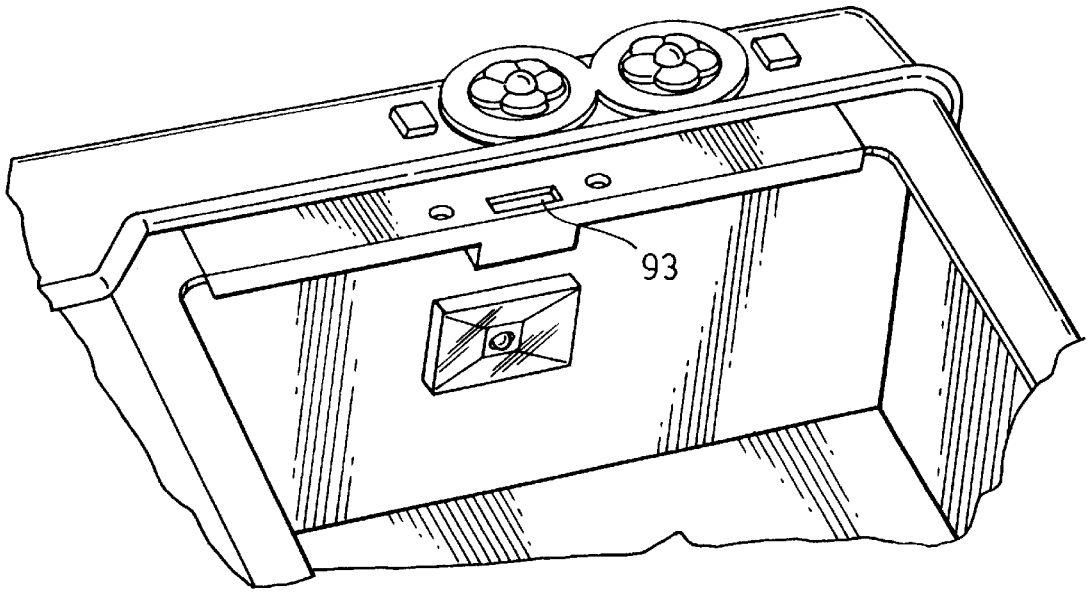
FIG. 9
FIG. 10.
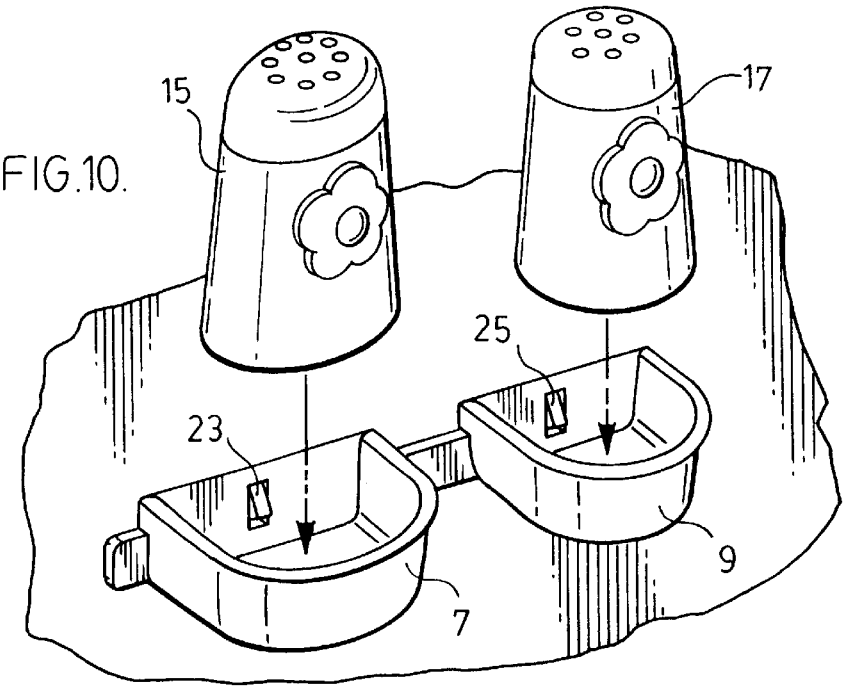

INTERACTIVE TOY PLAY SET WITH SENSORS

This application claims the benefit of U.S. Provisional Application No. 60/316,016 entitled "Interactive Toy Play Set," filed on Aug. 31, 2001.

BACKGROUND OF THE INVENTION

Toy play sets have been of interest to children for many years. Typically, such play sets are passive and the child who plays with them is left completely to his or her own imagination in terms of the placement of items in the play set and play scenarios appropriate to the play set. Accordingly, it would be an advantage to have a play set which is interactive with the child, in order to increase interest, to provide play scenarios, or to provide educational information or play structure.

SUMMARY OF THE INVENTION

In accordance with a principal aspect of the invention, a toy play set comprises: a body portion comprising: sound reproduction means; processing means comprising an integrated circuit comprising pre-programmed data adapted to be converted to audible sounds by said sound reproduction means; a source of electrical power to power said integrated circuit and said sound reproduction means; a base comprising first location means and sensor means; said sensor means adapted for electromagnetic communication with said integrated circuit; and a play item comprising: second location means; status means adapted to be sensed by the sensor means; said first location means adapted to cooperate with said second location means to locate the play item adjacent the base; such that when the play item is located adjacent the base and its status means is sensed by the sensor means, said sensor means generates a signal which is particular to said play item, said signal is transmitted to said integrated circuit, said integrated circuit generates a data segment from said pre-programmed data which data segment is appropriate to said play item, and said data segment is audibly reproduced by said sound reproduction means.

In further aspects of the invention:

(a) the sensor means is selected from one or more specific sensors, namely a mechanical sensor, a light sensor, and a magnetic sensor;
(b) the sensor means comprises at least two different specific sensors, each of which must sense said status means to trigger the sensor means to generate a signal;
(c) the sensor means comprises two sensors selected from a mechanical sensor, a light sensor, and a magnetic sensor;
(d) the mechanical sensor comprises at least one pressure activated switch, and the light sensor comprises a short-range infrared emitter and detector;
(e) the toy play set further comprises at least one accessory, said accessory adapted to be detected by the sensor means;
(f) the accessory is adapted to be detected by the magnetic sensor;
(g) the toy play set further comprises a plurality of play items, each play item comprising distinct trigger means adapted to be detected by the sensor means, and common status means adapted to be detected by the sensor means;
(h) the trigger means of each play item is adapted to trigger the mechanical sensor in a unique way, and the light sensor is adapted to detect the common status means;
(i) the trigger means of each play item is adapted to trigger the light sensor in a unique way, and the mechanical sensor is adapted to detect the common status means;

(j) the sensor means comprises a mechanical sensor, a light sensor, and a magnetic sensor, and further comprises at least one accessory, said accessory adapted to be detected by the magnetic sensor.

In a particular embodiment of the invention, a toy kitchen play set comprises: a body portion comprising: sound reproduction means; processing means comprising an integrated circuit comprising pre-programmed data adapted to be converted to audible sounds by said sound reproduction means; a source of electrical power to power said integrated circuit and said sound reproduction means; a stovetop with a burner comprising first location means and sensor means; said sensor means adapted for electromagnetic communication with said integrated circuit; and a play item comprising: second location means; status means adapted to be sensed by the sensor means; said first location means adapted to cooperate with said second location means to locate the play item adjacent the burner; such that when the play item is located adjacent the burner and its status means is sensed by the sensor means, said sensor means generates a signal which is particular to said play item, said signal is transmitted to said integrated circuit, said integrated circuit generates a data segment from said pre-programmed data which data segment is appropriate to said play item, and said comment is audibly reproduced by said sound reproduction means.

In further aspects of the particular embodiment of the invention, the toy kitchen play set comprises:

(a) a plurality of play items comprising a pot, a frying pan, and a kettle;
(b) each of the play items comprises a base, and each base comprises a relief pattern individually coded to contact or not to contact one or more switches selected from a plurality of mechanical switches in the sensor means in a unique way;
(c) the sensor means comprises infrared light sensor means, and each base comprises a portion adapted to be detected by said infrared light sensor means;
(d) a plurality of accessories, each said accessory comprising a magnet, wherein the sensor means comprises a magnetic detector adapted to detect an accessory when said accessory is placed in a play item located adjacent the burner;
(e) a toy oven comprising switch means triggered upon the opening or closing of a door of said oven, to define an oven condition, wherein the triggering of said switch means generates a signal to the integrated circuit, and said integrated circuit generates a comment from said pre-programmed data appropriate to said oven condition;
(f) a plurality of individually shaped utensils and a corresponding plurality of individually-shaped holders, each said holder adapted to receive only its corresponding utensil and a plurality of corresponding holder switch means associated with said holders and adapted to be triggered upon the placement or removal of a selected utensil from its corresponding holder, wherein the triggering of one of said holder switch means generates a signal to the integrated circuit, and said integrated circuit generates a data segment from said pre-programmed data appropriate to said selected utensil and its holder, and said data segment is audibly produced by said sound reproduction means.

Further aspects of the invention will be apparent from the following description and drawings.

BRIEF DESCRIPTION OF THE DRAWINGS

FIGS. 7A, 7B, 7C and 7D are schematic representations of accessories with magnets.

FIG. 9 is an upward, perspective view illustrating an oven and various controls and indicators.

FIG. 10 is a perspective view illustrating the structure of certain utensils and holders.

DETAILED DESCRIPTION OF THE INVENTION

The toy play set invention described herein is applicable to any appropriate toy play set. Such play sets may include a tool bench, a laboratory, a kitchen, a vanity, a bathroom, a bedroom, a travel case, a hairdressing salon, a concert stage, a recording studio, or any other appropriate play set environment.

For example, in a laboratory play set, the play items and accessories could include test tubes, beakers, burners, cleaning brushes, chemical containers, safety glasses, and the like. In a kitchen play set, the play items and accessories could include pots, pans, dishes, cups, cutlery, bowls, colanders, spray washing heads, various utensils, simulated food items, and the like. In a vanity play set, the play items could include a curling iron, a blow dryer, make-up containers, and the like. For a concert stage play set, the play items could include a microphone, an amplifier, musical instruments, and the like. Any suitable combination of play set and play items and accessories may be employed.

Figure 1:
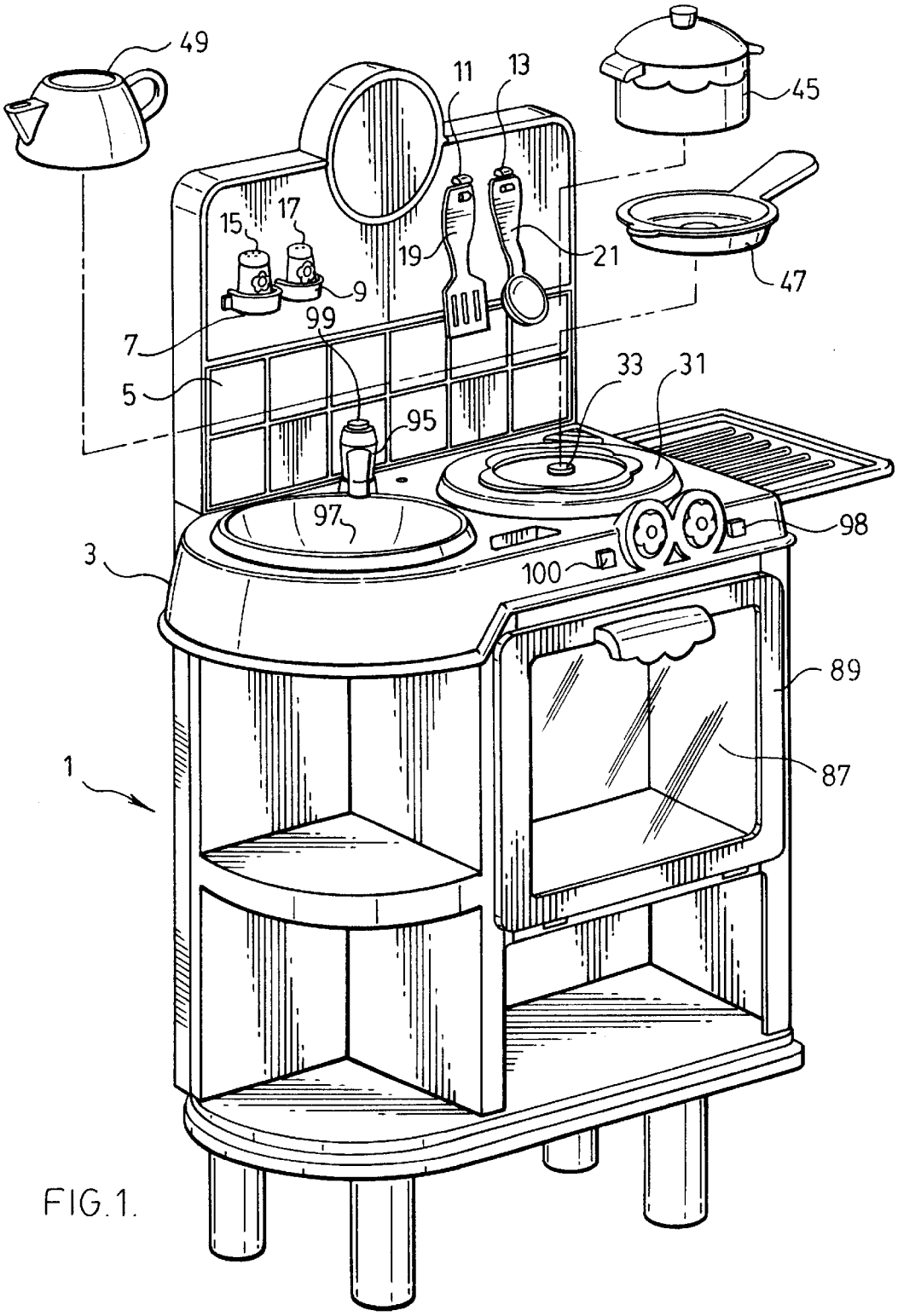
FIG. 1 is a front, perspective view of a toy kitchen play set.
Figure 2:
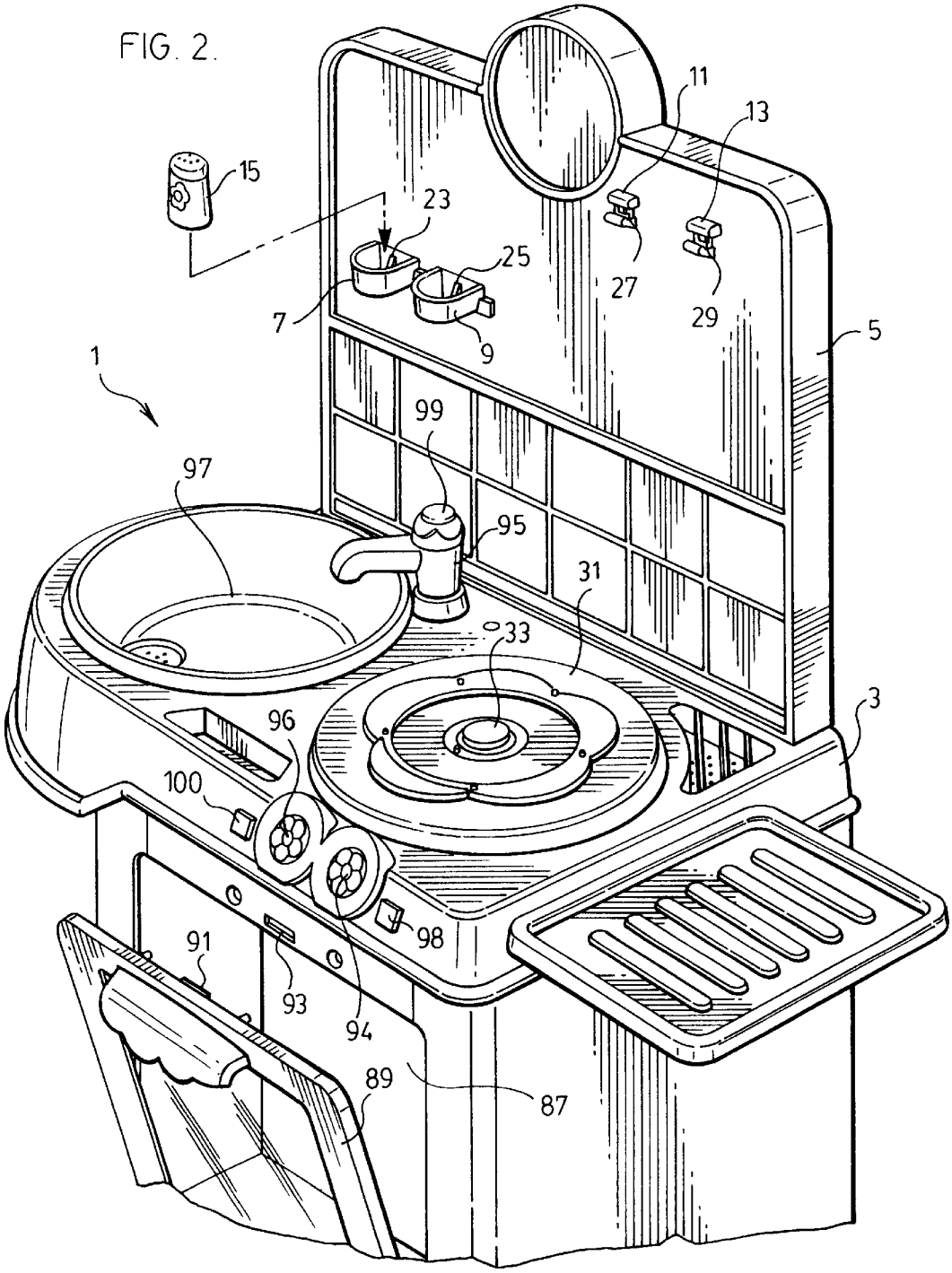
FIG. 2 is front, perspective view of a portion of a toy kitchen play set.
Figure 3:
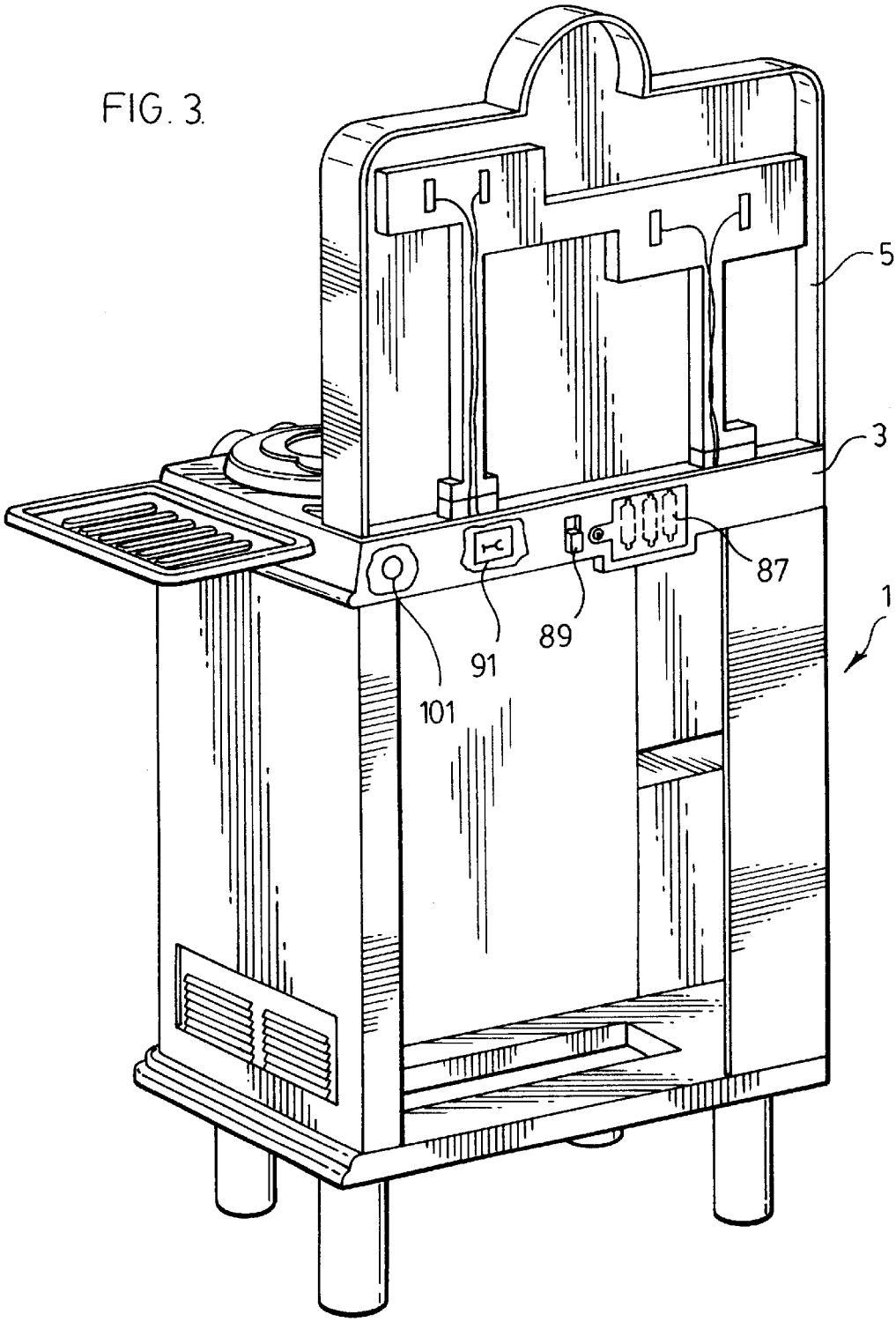
FIG. 3 is a rear, perspective view of a toy kitchen play set.
Figure 11A:
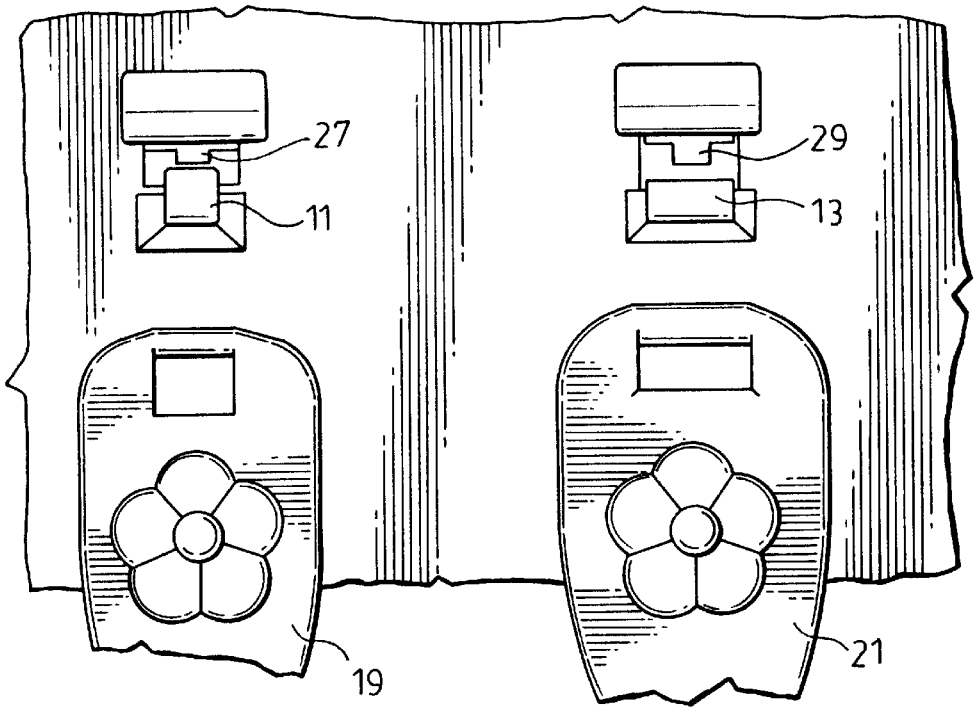
FIGS 11A and 11B are schematic, elevation views illustrating the structure of certain other utensils and holders.
Figure 11B:
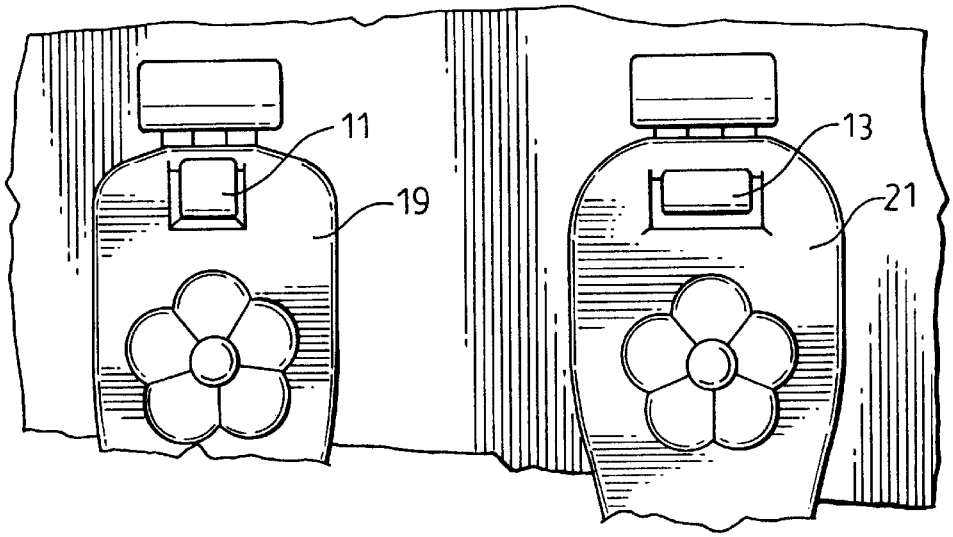

An illustrative embodiment of the invention is a toy kitchen play set (1). Referring to FIGS. 1 to 3, the kitchen play set (1) comprises a body portion (3) and a utensil rack (5). The utensil rack (5) comprises a number of holders (7, 9, 11, 13) adapted to hold various utensils (15, 17, 19, 21). Each holder comprises a mechanical switch (23, 25, 27, 29) connected electrically, or by some other electromagnetic means, to a control unit of the toy. In its simplest form, each utensil is adapted to be received only in its particular holder. In this case, an attempt to place the utensil in an incorrect holder will fail. When a utensil is correctly placed in its holder, the corresponding switch is triggered and a sound segment appropriate to the particular utensil can be generated, as more fully described hereinafter. As illustrated in FIG. 10, the holder (7) for the pepper shaker (15) is narrower and wider than the holder (9) for the salt shaker (17). Similarly, referring to FIGS. 11A and 11B, the holder protrusion (11) for the spatula (19) is higher and narrower than the holder protrusion (13) for the spoon (21). Thus, it is not physically possible to place an incorrect utensil chosen from this group in a holder designated for another utensil.

Figure 6:
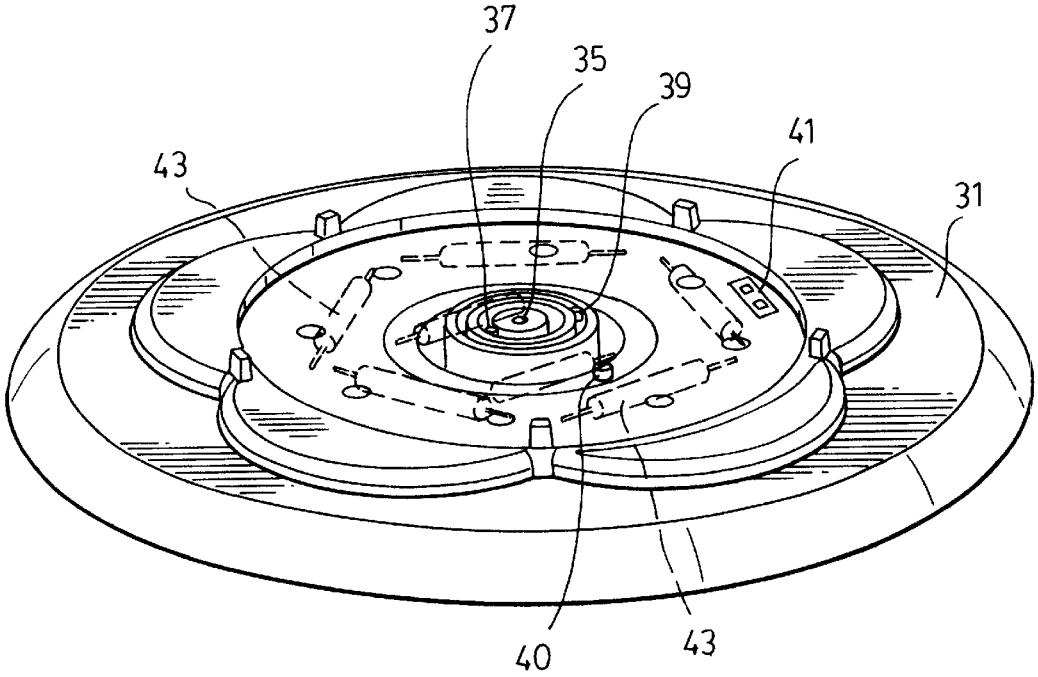
FIG. 6 is a perspective view of a stove top with sensors.

The base comprises a stove top or stove heating element (31). The stove top or burner element (31) comprises sensor means (33). In the preferred embodiment, the sensor means (33) comprises multiple individual sensors which may include mechanical switches (35, 37, 39, 40), an infrared emitter and detector (41), and a magnetic sensor (43). As illustrated in FIG. 6, an array of Reed switches may constitute the magnetic sensor (43). Although any individual sensor may be used to serve the purposes of this invention, the employment of multiple sensors, and additionally multiple forms of sensors, allows much greater diversity of play scenarios.

Figure 4:
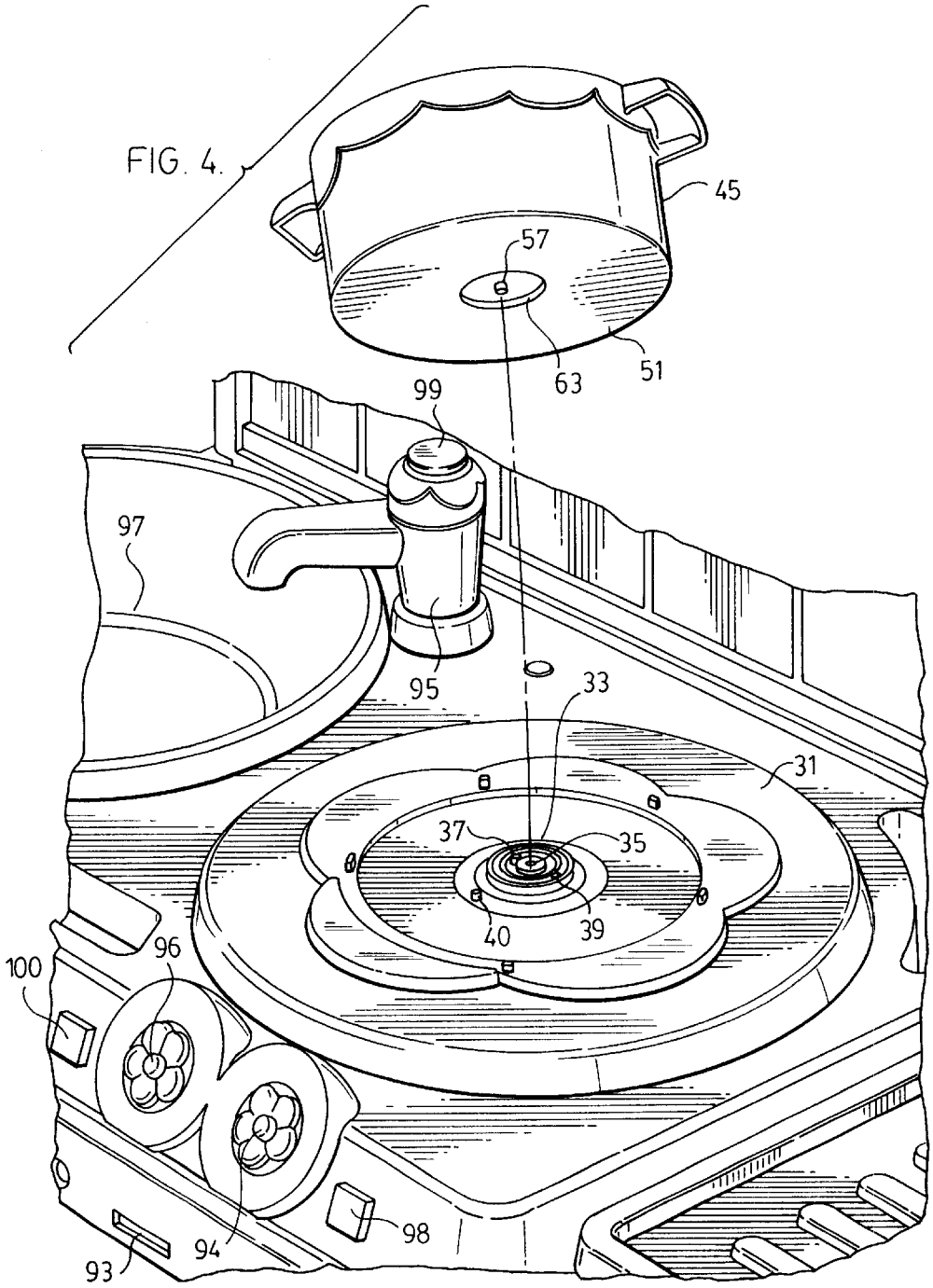
FIG. 4 is a front, perspective view of a portion of a toy kitchen play set.
Figure 5:
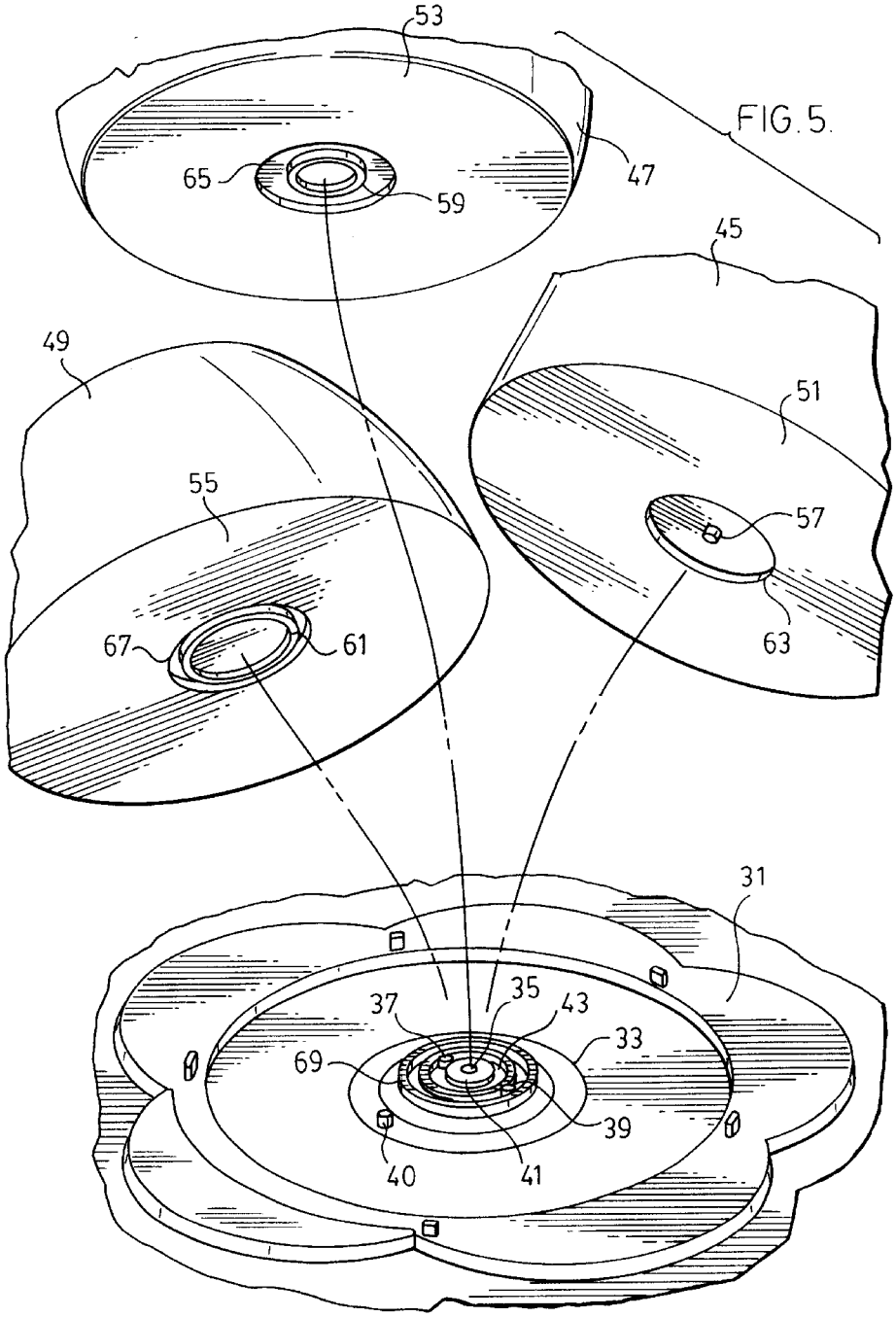
FIG. 5 is a schematic perspective view of play items in relation to a stove top.

As illustrated in FIGS. 1, 4 and 5, the toy play set further comprises a plurality of play items including a pot (45), a frying pan (47), and a tea kettle (49). The pot (45), frying pan (47), and tea kettle (49) respectively comprise bases (51, 53, 55). Each said base respectively comprises a relief pattern (57, 59, 61), adapted to contact, or not contact, one or more of the plurality of mechanical switches (35, 37, 39). In addition, each of the bases (51, 53, 55) is adapted to contact and trigger a general mechanical status switch (40). Each of the three play items may be provided with relief patterns designed to trigger one of three particular mechanical switches (35, 37, 39). Thus, when one of the switches (35, 37, 39) is triggered along with the status switch 40, a particular play item may be identified. Combinations of switches can be used to identify a considerably larger number of suitably coded play items. The requirement for triggering of both a status switch and a particular switch, or combination of switches, particular to a play item, helps to prevent false identification of play items by mere activation of individual switches, as further described below.

In the preferred embodiment shown, the outer circumferences (63, 65, 67) of the pot (45), frying pan (47), and tea kettle (49) respectively comprise second location means adapted to mate with a corresponding relief pattern (69) in the stove top or burner element surface (31), comprising first location means. Thus, cooperation between the first location means and the second location means serves to locate each play item in a uniform manner over the sensor means. The remainder of the relief pattern also may assist in locating the play item to the burner.

The placement of a play item on the burner to trigger one or more mechanical switches would be sufficient to identify the particular play item in question, given appropriate coding of the relief pattern on the base of each play item and the particular array of switches triggered when the play item is located on the burner.

For greater interest, however, a further sensor can be employed. For example, a child seeing the mechanical switches on the burner may attempt to trigger a response from the toy by pressing the switches individually or simultaneously. If this does not trigger a reaction from the toy, as more fully described below, the child will more fully appreciate the operation of the toy and will enjoy a greater sense of wonder at its operation. In order to avoid false readings, a second sensor can be employed. In its simplest version, this could be a light sensor which emits and detects short range infrared radiation. When the play item is correctly located on the burner, a portion of the base at a defined distance from the light sensor will serve to trigger that sensor. When both the appropriate array of mechanical switches and the light sensor are triggered, the toy will generate an appropriate sound effect or comment as more fully described below. Using such multiple sensors, a unique code and a common status can be employed. As described above, the common status arises from the placement of any play item in the vicinity of the general mechanical switch (40), or the light sensor (41), as the case may be, while the unique status of the play item is determined by the array of mechanical sensors triggered. The reverse of this arrangement could also be employed. For example, a common mechanical sensor could be triggered for the common status while a selection from an array of light sensors could be triggered to determine the unique character of the play item.

Alternatively, a magnetic sensor could be used to determine the common status of the play item if each play item were provided with a magnet. Thus, non-magnetic items employed by a child would not trigger the common status sensor. Either mechanical switches or light sensors, or a combination thereof, could be used to determine the unique character of the play item.

As described below, however, greater diversity respecting use of the toy may be obtained by preserving the use of a magnetic sensor for another category of play set elements. In this regard, as illustrated in FIGS. 7A, 7B, 7C and 7D, accessories (71, 73, 75, 77) corresponding to various food items (such as a steak, a potato, an egg, or a cob of corn) may each respectively be provided with a magnet (79, 81, 83, 85). When the food items are placed inside the pot or the frying pan, the magnets will be in close enough proximity to the magnetic sensor (43) in the stove top in order to trigger a further reaction by means of the processing means. A single magnetic sensor, or an array of such sensors, may be employed as appropriate.

Thus, using the array of different sensors, the toy can be programmed to recognize specific play items, such as a pot or frying pan, and whether food is present in them. A sophisticated combination of magnets and magnetic sensors may be employed to further identify individual food items from a plurality of such food items.

The kitchen play set may additionally be provided with an oven (87) and oven door (89) as illustrated in FIGS. 1, 2 and 9. The oven door (89) may be provided with a protrusion (91) adapted to trigger a switch (93) when the oven door is opened or closed. Again, when this condition of the switch being open or closed is sensed, the toy may be prompted to generate appropriate sound segments including sound effects and spoken comments. By placing a "magnetic" sensor in the base of the oven (not shown), in a similar manner to the placement of a magnetic sensor in the burner, the presence of food item accessories in the oven may be detected and, upon generation of appropriate signals to the processing means, an appropriate data segment may be selected and audibly reproduced.

The toy may also be provided with other accessories such as a faucet (95) and sink (97) as illustrated in FIGS. 1, 2 and 4. When a button (99) connected to an electrical switch on the faucet (95) is depressed, appropriate sound effects and/or commentary may be generated as discussed previously. Other peripheral items could, of course, also be employed in a similar fashion.

Figure 8:
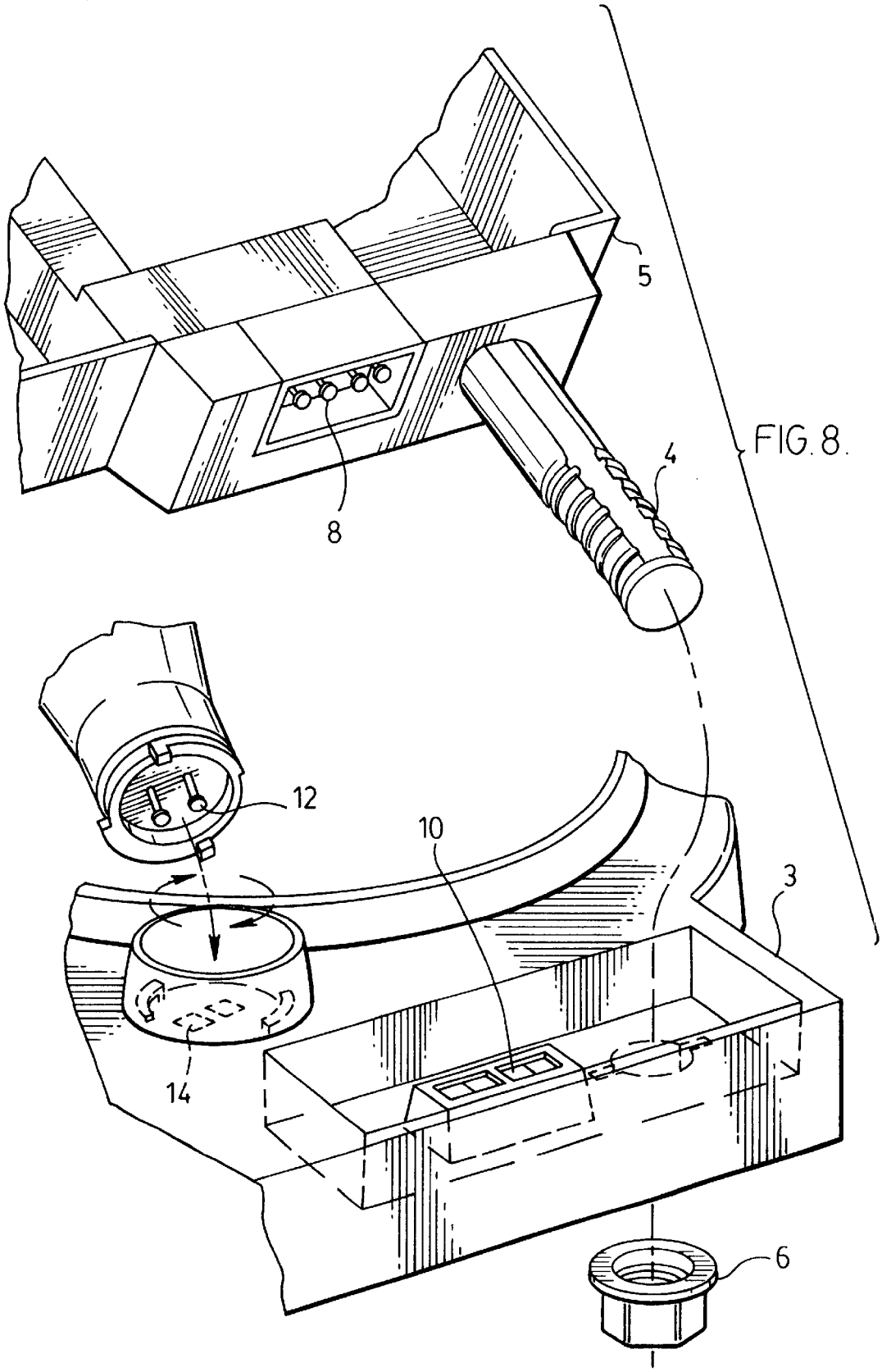
FIG. 8 is a schematic, perspective, rear view of a play set illustrating the connection of the base and utensil rack.

Referring to FIG. 8, The utensil rack (5) may be connected to the base (3) using appropriate bolts (4) and nuts (6). Appropriate electrical connections between the utensil rack and the base may be supplied using fittings (8, 10, 12, 14), also as illustrated in FIG. 8.

The toy is typically powered by electrical storage batteries (87) as illustrated in FIG. 3. Electrical power and signals are carried by standard electrical wire (not specifically illustrated) or may be transmitted using forms of electromagnetic radiation including infrared light, radio waves, or the like, as known in the art. As used herein, the term "electromagnetic communication" refers to both electrical and non-electrical power and signals. The flow of power to the toy is controlled by control switch (89) which may be moved between "Play", "Off" or "Try Me" positions as known in the art.

Still referring to FIG. 3, the toy comprises processing means comprising one or more integrated circuits (91) comprising a variety of pre-recorded data so that suitable triggers will generate one or more suitable pre-recorded data segments comprising sound effects or voice commentaries, which are then reproduced by sound reproduction means (101) comprising one or more audio speakers and related electronics, as known in the art. Initiation of oven or stove functions may occur when push buttons (94, 96) are depressed. An indication that the toy is in operation can be given by lights (98, 100).

Further aspects of the invention will be apparent to those skilled in the art and the invention is not to be taken as restricted to the preferred embodiment illustrated.

What is claimed is:

1. A toy play set comprising:

(a) a body portion comprising:

(i) sound reproduction means;

(ii) processing means comprising an integrated circuit comprising pre-programmed data adapted to be converted to audible sounds by said sound reproduction means;

(iii) a source of electrical power to power said integrated circuit and said sound reproduction means;

(iv) a base comprising first location means and sensor means;

(v) said sensor means adapted for electromagnetic communication with said integrated circuit;

(b) a play item comprising:

(i) second location means;

(ii) status means adapted to be sensed by the sensor means;

said first location means adapted to co-operate with said second location means to locate the play item adjacent the base;

such that when the play item is located adjacent the base and its status means is sensed by the sensor means, said sensor means generates a signal which is particular to said play item, said signal is transmitted to said integrated circuit, said integrated circuit generates a data segment from said pre-programmed data which data segment is appropriate to said play item, and said data segment is audibly reproduced by said sound reproduction means.

2. The toy play set of claim 1, wherein the sensor means is selected from one or more specific sensors, namely a mechanical sensor, a light sensor, and a magnetic sensor.

3. The toy play set of claim 2, wherein the sensor means comprises at least two different specific sensors, each of which must sense said status means to trigger the sensor means to generate a signal.

4. The toy play set of claim 3, wherein the sensor means comprises a mechanical sensor and a light sensor.

5. The toy play set of claim 3, wherein the sensor means comprises a mechanical sensor and a magnetic sensor.

6. The toy play set of claim 3, wherein the sensor means comprises a magnetic sensor and a light sensor.

7. The toy play set of claim 4, wherein the mechanical sensor comprises at least one pressure activated switch, and the light sensor comprises a short-range infrared emitter and detector.

8. The toy play set of claim 5, wherein the mechanical sensor comprises a plurality of pressure activated switches.

9. The toy play set of claim 6, wherein the light sensor comprises a short-range infrared emitter and detector.

10. The toy play set of claim 1, further comprising at least one accessory, said accessory adapted to be detected by the sensor means.

11. The toy play set of claim 2, further comprising at least one accessory, said accessory adapted to be detected by the sensor means.

12. The toy play set of claim 11, wherein the accessory is adapted to be detected by the magnetic sensor.

13. The toy play set of claim 3, further comprising at least one accessory, said accessory adapted to be detected by the sensor means.

14. The toy play set of claim 13, wherein the accessory is adapted to be detected by the magnetic sensor.

15. The toy play set of claim 1, further comprising a plurality of play items, each play item comprising distinct trigger means adapted to be detected by the sensor means, and common status means adapted to be detected by the sensor means.

16. The toy play set of claim 15, wherein the sensor means comprises a mechanical sensor and a light sensor.

17. The toy play set of claim 16, wherein the trigger means of each play item are adapted to trigger the mechanical sensor in a unique way, and the light sensor is adapted to detect the common status means.

18. The toy play set of claim 17, wherein the trigger means of each play item is adapted to trigger the light sensor in a unique way, and the mechanical sensor is adapted to detect the common status means.

19. The toy play set of claim 15, further comprising at least one accessory, said accessory adapted to be detected by the sensor means.

20. The toy play set of claim 16, wherein the sensor means further comprises a magnetic sensor, and further comprising at least one accessory, said accessory adapted to be detected by the magnetic sensor.

21. The toy play set of claim 17, wherein the sensor means further comprises a magnetic sensor, and further comprising at least one accessory, said accessory adapted to be detected by the magnetic sensor.

22. The toy play set of claim 18, wherein the sensor means further comprises a magnetic sensor, and further comprising at least one accessory, said accessory adapted to be detected by the magnetic sensor.

23. A toy kitchen play set comprising:

(a) a body portion comprising:
- (i) sound reproduction means;
- (ii) processing means comprising an integrated circuit comprising pre-programmed data adapted to be converted to audible sounds by said sound reproduction means;
- (iii) a source of electrical power to power said integrated circuit and said sound reproduction means;
- (iv) a stove-top comprising a burner comprising first location means and sensor means;
- (v) said sensor means adapted for electromagnetic communication with said integrated circuit;

(b) a play item comprising:
- (i) second location means;
- (ii) status means adapted to be sensed by the sensor means;

said first location means adapted to co-operate with said second location means to locate the play item adjacent the burner;

such that when the play item is located adjacent the burner and its status means is sensed by the sensor means, said sensor means generates a signal which is particular to said play item, said signal is transmitted to said integrated circuit, said integrated circuit generates a data segment from said pre-programmed data which data segment is appropriate to said play item, and said data segment is audibly reproduced by said sound reproduction means.

24. The toy kitchen play set of claim 23, comprising a plurality of play items.

25. The toy kitchen play set of claim 24, wherein the plurality of play items comprises a pot, a frying pan, and a kettle.

26. The toy kitchen play set of claim 25, wherein each of the play items comprises a base, and wherein each said base comprises a relief pattern individually coded to contact or not to contact one or more switches selected from a plurality of mechanical switches in the sensor means in a unique way.

27. The toy kitchen play set of claim 26, wherein the sensor means comprises infra-red light sensor means, and wherein each base comprises a portion adapted to be detected by said infra-red light sensor means.

28. The toy kitchen play set of claim 27, further comprising a plurality of accessories, each said accessory comprising a magnet, wherein the sensor means comprises a magnetic detector adapted to detect an accessory when said accessory is placed in a play item located adjacent the burner.

29. The toy kitchen play set of claim 28, further comprising a toy oven comprising switch means triggered upon the opening or closing of a door of said oven, to define an oven condition, wherein the triggering of said switch means generates a signal to the integrated circuit, and said integrated circuit generates a data segment from said pre-programmed data appropriate to said oven condition.

30. The toy kitchen play set of claim 29, further comprising a magnetic sensor adjacent the oven adapted to detect the presence of an accessory when said accessory is placed in the oven.

31. The toy kitchen play set of claim 28, further comprising a plurality of individually shaped utensils, and a corresponding plurality of individually-shaped holders, each said holder adapted to receive only its corresponding utensil, and a plurality of corresponding holder switch means associated with said holders and adapted to be triggered upon the placement or removal of a selected utensil from its corresponding holder, wherein the triggering of one of said holder switch means generates a signal to the integrated circuit, and said integrated circuit generates a data segment from said pre-programmed data appropriate to said selected utensil and its holder.

* * * * *